US009393461B1

(12) United States Patent
Villagra

(10) Patent No.: US 9,393,461 B1
(45) Date of Patent: Jul. 19, 2016

(54) LEG AGILITY EXERCISE ASSEMBLY

(71) Applicant: Gustavo R. Villagra, Wethersfield, CT (US)

(72) Inventor: Gustavo R. Villagra, Wethersfield, CT (US)

( * ) Notice: Subject to any disclaimer, the term of this patent is extended or adjusted under 35 U.S.C. 154(b) by 511 days.

(21) Appl. No.: 13/732,705

(22) Filed: Jan. 2, 2013

(51) Int. Cl.
*A63B 21/00* (2006.01)
*A63B 26/00* (2006.01)

(52) U.S. Cl.
CPC ..... *A63B 26/003* (2013.01)

(58) Field of Classification Search
CPC ..... A63B 21/00
USPC ..... 482/93, 111, 148, 23, 74, 112
See application file for complete search history.

(56) References Cited

U.S. PATENT DOCUMENTS

| | | | | |
|---|---|---|---|---|
| 4,075,922 | A * | 2/1978 | Smith | 84/402 |
| 4,134,586 | A | 1/1979 | King | |
| 4,795,164 | A | 1/1989 | Morpeau | |
| 4,901,617 | A * | 2/1990 | Malone et al. | 84/402 |
| 4,976,651 | A * | 12/1990 | Frank | 446/421 |
| D336,101 | S * | 6/1993 | Lewis | D17/22 |
| 5,669,833 | A | 9/1997 | Stone | |
| 5,692,975 | A | 12/1997 | Hesse | |
| 5,873,798 | A | 2/1999 | Bostick | |
| 6,447,427 | B1 | 9/2002 | Myrland et al. | |
| 6,955,631 | B2 | 10/2005 | Chen Wu | |
| 7,699,759 | B1 * | 4/2010 | Page | 482/93 |
| D632,352 | S | 2/2011 | Pauletto et al. | |
| 2005/0124440 | A1 | 6/2005 | Folz | |
| 2010/0298074 | A1 | 11/2010 | Esposito | |

* cited by examiner

*Primary Examiner* — Jerome w Donnelly

(57) ABSTRACT

A leg agility exercise assembly enhances speed of rotational movement for the knee, ankle and waist by facilitating exercising in a curved motion. The assembly includes a plurality of elongated legs. Each leg has a first end and a second end. Each of a plurality of holes extends through an associated one of the legs. Each hole is positioned proximate the first end of the associated leg. Each of a plurality of apertures also extends through an associated one of the legs. Each aperture is positioned proximate the second end of the associated leg. A post is insertable through each hole wherein the post is selectively couplable to each leg.

8 Claims, 5 Drawing Sheets

LEG AGILITY EXERCISE ASSEMBLY

BACKGROUND OF THE DISCLOSURE

Field of the Disclosure

The disclosure relates to exercise devices and more particularly pertains to a new exercise device for enhancing speed of rotational movement for the knee, ankle and waist by facilitating exercising in a curved motion.

SUMMARY OF THE DISCLOSURE

An embodiment of the disclosure meets the needs presented above by generally comprising a plurality of elongated legs. Each leg has a first end and a second end. Each of a plurality of holes extends through an associated one of the legs. Each hole is positioned proximate the first end of the associated leg. Each of a plurality of apertures also extends through an associated one of the legs. Each aperture is positioned proximate the second end of the associated leg. A post is insertable through each hole wherein the post is selectively couplable to each leg.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
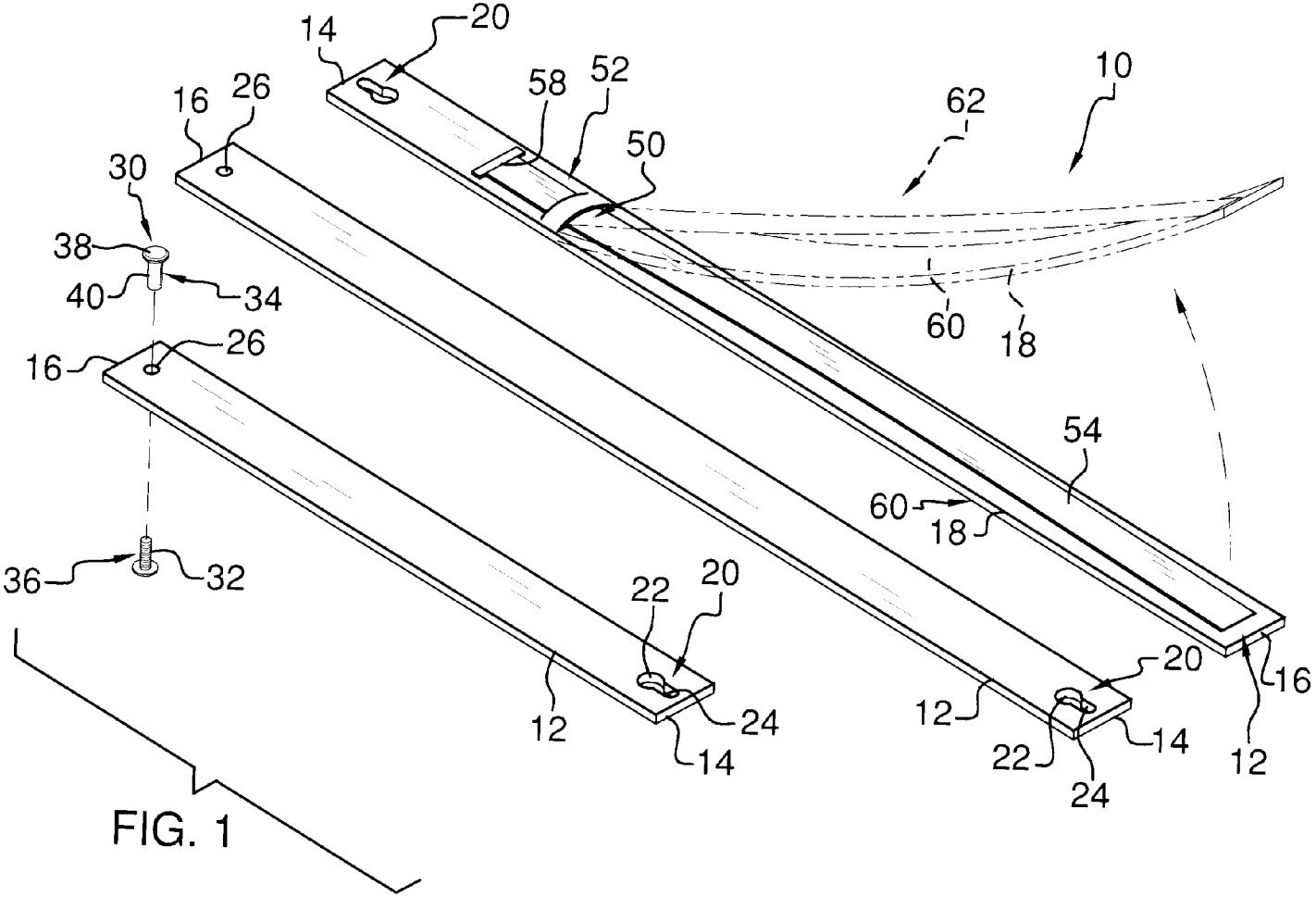
FIG. 1 is a partially exploded top front side perspective view of a leg agility exercise assembly according to an embodiment of the disclosure.
Figure 2:
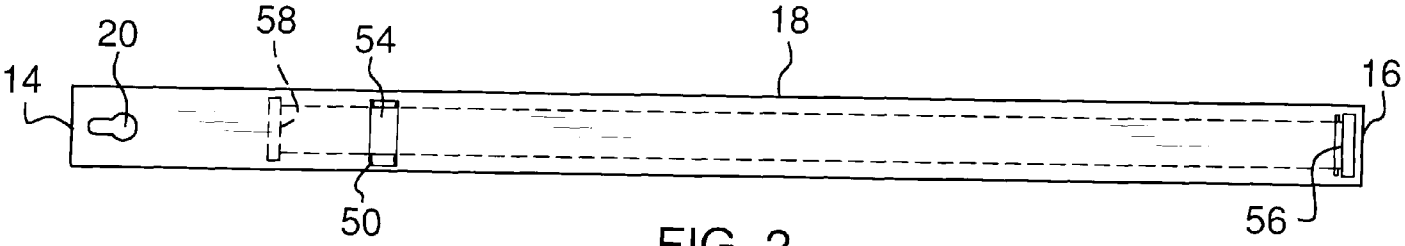
FIG. 2 is a bottom view of an embodiment of the disclosure.
Figure 3:
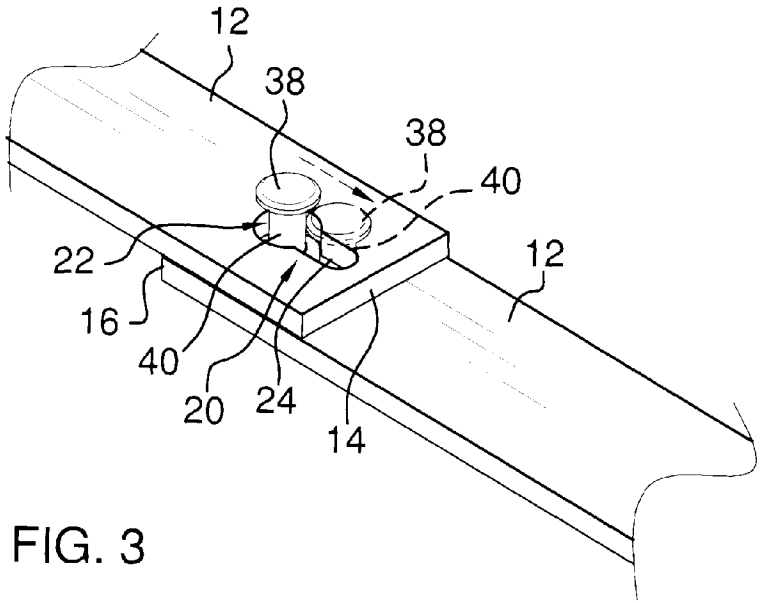
FIG. 3 is a detailed top front side perspective view of an embodiment of the disclosure.
Figure 5:
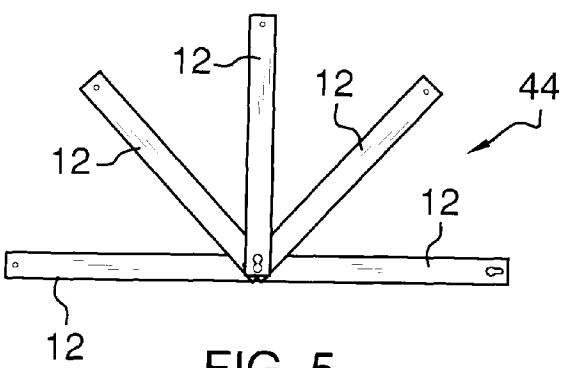
FIG. 5 is a top view of a configuration of an embodiment of the disclosure.
Figure 7:
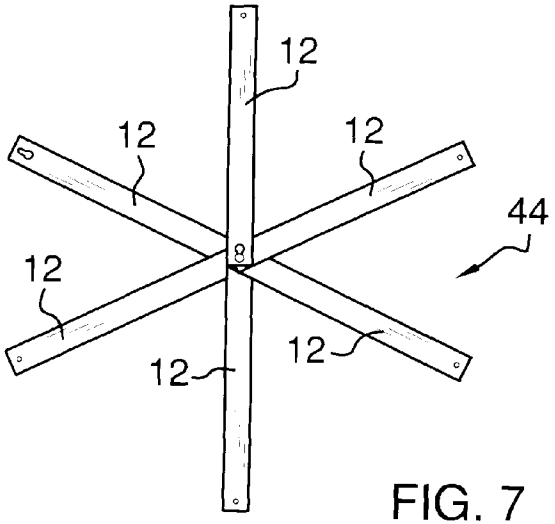
FIG. 7 is a top view of a configuration of an embodiment of the disclosure.
Figure 4:
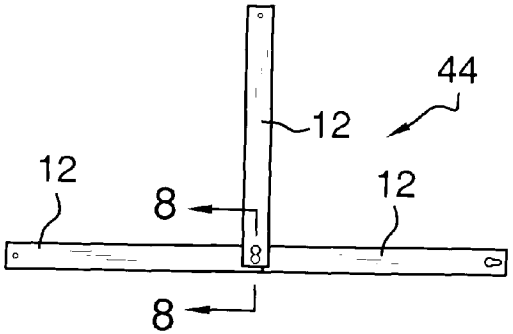
FIG. 4 is a top view of a configuration of an embodiment of the disclosure.
Figure 6:
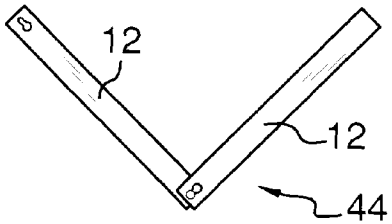
FIG. 6 is a top view of a configuration of an embodiment of the disclosure.
Figure 8:
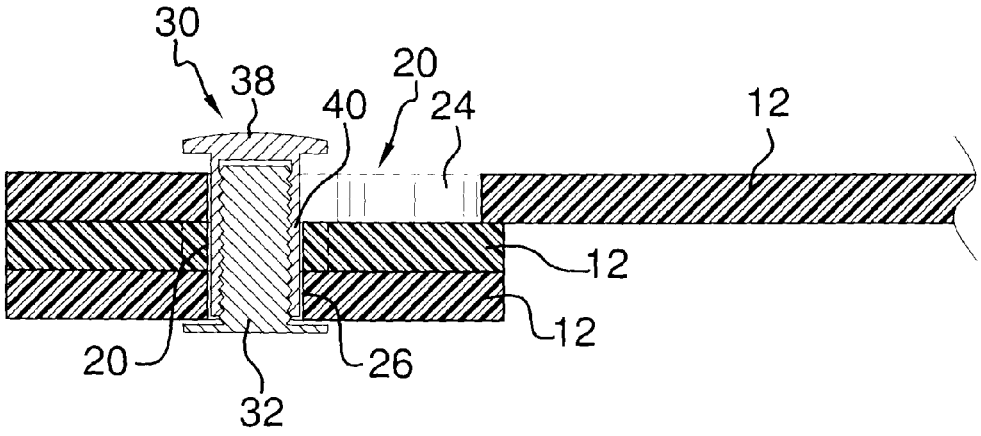
FIG. 8 is a cross-sectional view of an embodiment of the disclosure taken along line 8-8 of FIG. 4.
Figure 9:
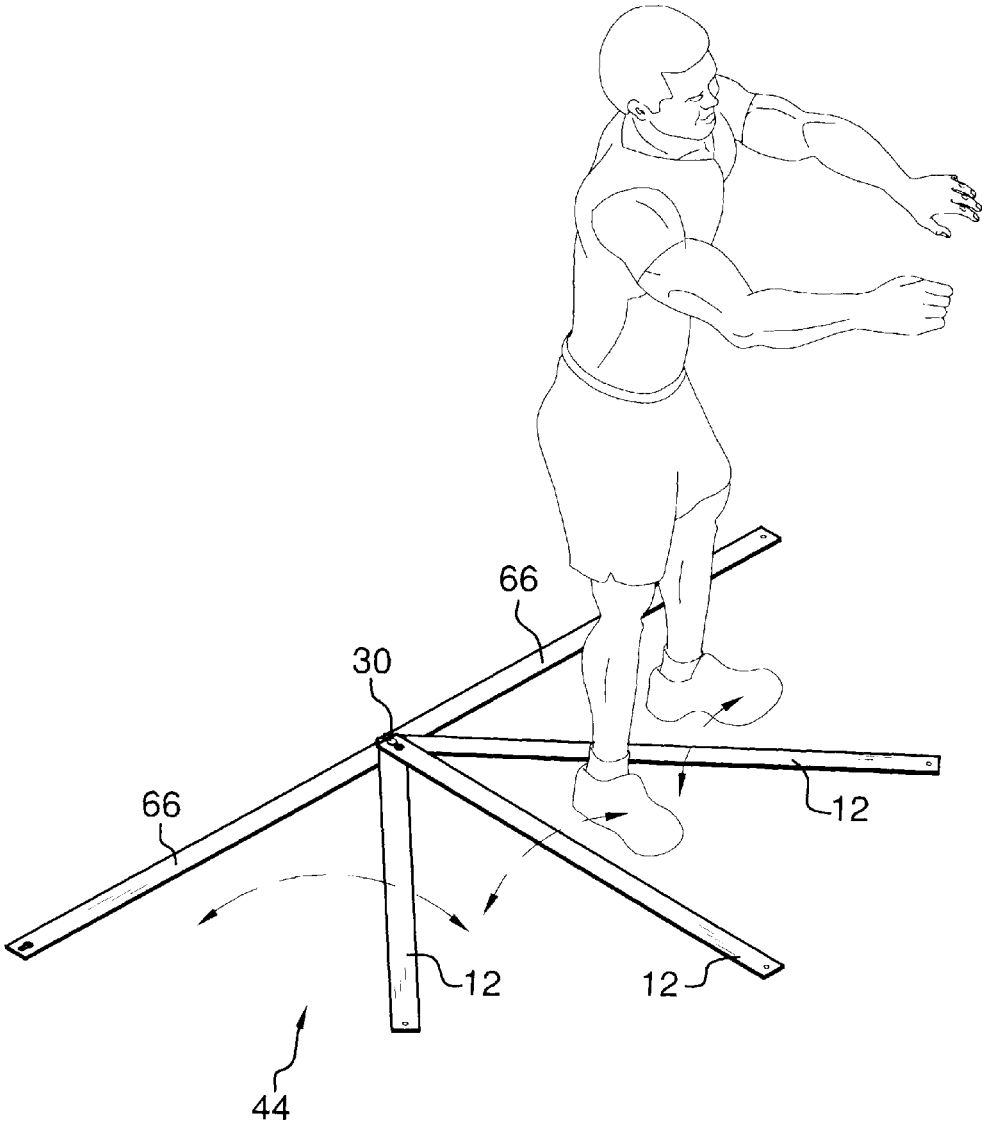
FIG. 9 is a top front side perspective view of an embodiment of the disclosure in use.

With reference now to the drawings, and in particular to FIGS. 1 through 9 thereof, a new exercise device embodying the principles and concepts of an embodiment of the disclosure and generally designated by the reference numeral 10 will be described.

As best illustrated in FIGS. 1 through 9, the leg agility exercise assembly 10 generally comprises a plurality of elongated legs 12. Each leg 12 has a first end 14 and a second end 16. The plurality of legs 12 may include at least one flexible leg 18. Each flexible leg 18 is flexible along a longitudinal axis of the flexible leg 18. Each of a plurality of holes 20 extends through an associated one of the legs 12. Each hole 20 is positioned proximate the first end 14 of the associated leg 12 and has a broad portion 22 and a slot portion 24. Each of a plurality of apertures 26 extends through an associated one of the legs 12. Each aperture 26 is positioned proximate the second end 16 of the associated leg 12. Each aperture 26 is round.

A post 30 is insertable through each hole 20 wherein the post 30 is selectively couplable to each leg 12. Each aperture 26 is sized to selectively receive the post 30 therethrough. The post 30 may have a bottom section 32 and a top section 34. The bottom section 34 has a threaded portion 36 is removably insertable into the top section 32 coupling the top section 32 to the bottom section 34. The post 30 has a head 38 and a shaft 40 coupled to and extending from the head 38. The head 38 of the post 30 is sized to extend through the broad portion 22 of each hole 20. The slot portion 24 of each hole 20 is sized to prevent the head 38 of the post 30 from passing through the slot portion 24 of the hole 20. The legs 12 are interconnectable by inserting the post 30 through the hole 20 of a selected one of the legs 12 and either the hole 20 or the aperture 26 of each other leg 12 to form a radial array 44 of the legs 12 extending from the post 30.

A slit 50 may be positioned in an upper surface 52 of each flexible leg 18. The slit 50 is positioned in spaced relationship to the second end 16 of the flexible leg 18. A strap 54 is coupled to the flexible leg 18. The strap 54 passes through the slit 50. The strap 54 has a first end 56 coupled to the flexible leg 18 proximate the second end 16 of the flexible leg 18. A second end 58 of the strap 54 is free relative to the flexible leg 18. The slit 50 engages the strap 54 when the strap 54 is pulled through the slit 50 such that the strap 54 urges a distal portion 60 between the slit 50 and the second end of the flexible leg 18 into a curved position 62. Each flexible leg 18 or legs 12 used as outer members 66 of the array 44 may have a greater length than each other leg 12 in a middle portion of the array 44. Thus, a person may have a visual indication of reaching the outer portions of the array 44 by seeing the curved flexible legs 18 or seeing the longer outer legs 12.

In use, the legs 12 are assembled into the radial array 44. Each flexible leg 18 may be positioned at a desired position in the array 44 such as at opposite ends of the array 44. A person stands with their feet between adjacent legs 12 in the array 44 and quickly jumps or steps in a radial motion keeping their back to the post 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A leg agility exercise assembly comprising:

a plurality of elongated legs, each leg having a first end and a second end;

a plurality of holes, each hole extending through an associated one of said legs, each hole being positioned proximate said first end of said associated leg;

a plurality of apertures, each aperture extending through an associated one of said legs, each aperture being positioned proximate said second end of said associated leg; and a post, said post being insertable through each said hole wherein said post is selectively couplable to each said leg, said post having a head and a shaft coupled to and extending from said head; and each said hole having a broad portion and a slot portion, said head of said post being sized to extend through said broad portion of said hole, said slot portion of said hole being sized to prevent said head of said post from passing through said slot portion of said hole.

2. A leg agility exercise assembly comprising:

a plurality of elongated legs, each leg having a first end and a second end;

a plurality of holes, each hole extending through an associated one of said legs, each hole being positioned proximate said first end of said associated leg;

a plurality of apertures, each aperture extending through an associated one of said legs, each aperture being positioned proximate said second end of said associated leg;

a post, said post being insertable through each said hole wherein said post is selectively couplable to each said leg; and said legs being interconnected by inserting said post through said hole of a selected one of said legs and one of said hole and said aperture of each other said leg forming a radial array of said legs extending from said post.

3. A leg agility exercise assembly comprising:

a plurality of elongated legs, each leg having a first end and a second end;

a plurality of holes, each hole extending through an associated one of said legs, each hole being positioned proximate said first end of said associated leg;

a plurality of apertures, each aperture extending through an associated one of said legs, each aperture being positioned proximate said second end of said associated leg; and a post, said post being insertable through each said hole wherein said post is selectively couplable to each said leg; and said plurality of legs including at least one flexible leg, said flexible leg being flexible along a longitudinal axis of said flexible leg.

4. The assembly of claim 3, further comprising:

a slit positioned in an upper surface of said flexible leg, said slit being positioned in spaced relationship to said second end of said flexible leg; and a strap coupled to said flexible leg, said strap passing through said slit, said strap having a first end coupled to said flexible leg proximate said second end of said flexible leg, a second end of said strap being free relative to said flexible leg, said slit engaging said strap when said strap is pulled through said slit wherein said strap urges a distal portion of said flexible leg into a curved position.

5. The assembly of claim 2, further comprising said post having a head and a shaft coupled to and extending from said head.

6. The assembly of claim 1, further comprising said post having a bottom section and a top section, said bottom section being removably coupled to said top section.

7. The assembly of claim 6, further comprising each said aperture being round, each said aperture being sized to receive said post therethrough.

8. The assembly of claim 1, further comprising:

said plurality of legs including at least one flexible leg, each said flexible leg being flexible along a longitudinal axis of said flexible leg;

each said aperture being round; and each said aperture being sized to selectively receive said post therethrough, said post having a bottom section and a top section, said bottom section being removably coupled to said top section, said legs being interconnectable by inserting said post through said hole of a selected one of said legs and one of said hole and said aperture of each other said leg forming a radial array of said legs extending from said post;

a slit positioned in an upper surface of said flexible leg, said slit being positioned in spaced relationship to said second end of said flexible leg; and a strap coupled to said flexible leg, said strap passing through said slit, said strap having a first end coupled to said flexible leg proximate said second end of said flexible leg, a second end of said strap being free relative to said flexible leg, said slit engaging said strap when said strap is pulled through said slit wherein said strap urges a distal portion of said flexible leg into a curved position.

* * * * *